US009745029B1

(12) United States Patent
Knowles et al.

(10) Patent No.: US 9,745,029 B1
(45) Date of Patent: Aug. 29, 2017

(54) OXYGEN TANK FLOTATION DEVICE

(71) Applicants: Nannette Knowles, Mesa, AZ (US); James Knowles, Mesa, AZ (US)

(72) Inventors: Nannette Knowles, Mesa, AZ (US); James Knowles, Mesa, AZ (US)

( * ) Notice: Subject to any disclaimer, the term of this patent is extended or adjusted under 35 U.S.C. 154(b) by 0 days.

(21) Appl. No.: 15/226,975

(22) Filed: Aug. 3, 2016

(51) Int. Cl.

| | |
|---|---|
| ***B65D 88/78*** | (2006.01) |
| ***B63B 1/00*** | (2006.01) |
| ***B63B 35/613*** | (2006.01) |
| ***B63B 35/85*** | (2006.01) |
| ***A47G 33/12*** | (2006.01) |
| ***B63B 35/73*** | (2006.01) |
| *B63C 11/46* | (2006.01) |

(52) U.S. Cl.
CPC ..... *B63B 35/73* (2013.01)

(58) Field of Classification Search
CPC ..... B63B 35/00; B63B 35/34; B63B 35/38; B63B 35/58; B63B 35/73; B63B 35/735; B63B 35/737; B63B 2035/00; B63B 2035/73; B63B 2035/735; B63B 2035/737; B63B 2735/00
USPC ..... 114/256, 266, 267, 292, 315; 441/44, 441/136
See application file for complete search history.

(56) References Cited

U.S. PATENT DOCUMENTS

| | | | | |
|---|---|---|---|---|
| 4,348,976 | A * | 9/1982 | Gilbert | A63B 35/12 114/315 |
| 4,571,194 | A | 2/1986 | Kiss | |
| 4,645,465 | A * | 2/1987 | Courtney | B63C 9/18 405/186 |
| 4,674,493 | A * | 6/1987 | Mitchell | B63C 11/202 128/201.11 |
| 4,919,631 | A * | 4/1990 | Stafford | B63C 11/202 114/315 |
| 5,082,464 | A * | 1/1992 | Clink | B63C 11/46 114/315 |
| 5,671,694 | A * | 9/1997 | Schoettle | B63B 35/71 114/347 |
| 5,727,709 | A | 3/1998 | Nobile | |
| 6,029,845 | A | 2/2000 | Mueller | |
| 7,909,540 | B2 * | 3/2011 | Leishman | B63C 11/02 128/201.27 |
| D668,308 | S | 10/2012 | Gilmore | |
| 9,187,160 | B2 * | 11/2015 | McJunkin | B63C 11/18 |
| 2003/0101994 | A1 * | 6/2003 | Potkin | B63C 11/20 128/201.27 |
| 2014/0110413 | A1 | 4/2014 | Kelly | |
| 2015/0041476 | A1 | 2/2015 | Weisgt | |

FOREIGN PATENT DOCUMENTS

| | | |
|---|---|---|
| WO | 2008115106 A1 | 9/2008 |

* cited by examiner

*Primary Examiner* — Daniel V Venne

(57) ABSTRACT

The oxygen tank flotation device is a floating structure adapted for use in recreational water activities. The oxygen tank flotation device is adapted for use with respiratory equipment that is required for use during recreational water activities. The oxygen tank flotation device receives and stores respiratory equipment, such as an oxygen tank, in such a manner that the respiratory equipment will float when the oxygen tank flotation device is placed in a body of water. This arrangement allows the respiratory equipment to float near the user when the user is involved in recreational water activities. The oxygen tank flotation device comprises a vessel, a first float, and a second float.

14 Claims, 4 Drawing Sheets

OXYGEN TANK FLOTATION DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of nautical vessels or like floating structures, more specifically, buoyant device for supporting respiratory equipment during recreational activities.

SUMMARY OF INVENTION

The oxygen tank flotation device is a floating structure adapted for use in recreational water activities. The oxygen tank flotation device is adapted for use with respiratory equipment that is required for use during recreational water activities. The oxygen tank flotation device receives and stores respiratory equipment, such as an oxygen tank, in such a manner that the respiratory equipment will float when the oxygen tank flotation device is placed in a body of water. This allows the respiratory equipment to float near the user when the user is involved in recreational water activities.

These together with additional objects, features and advantages of the oxygen tank flotation device will be readily apparent to those of ordinary skill in the art upon reading the following detailed description of the presently preferred, but nonetheless illustrative, embodiments when taken in conjunction with the accompanying drawings.

In this respect, before explaining the current embodiments of the oxygen tank flotation device in detail, it is to be understood that the oxygen tank flotation device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the oxygen tank flotation device.

It is therefore important that the claims be regarded as including such equivalent construction insofar as they do not depart from the spirit and scope of the oxygen tank flotation device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
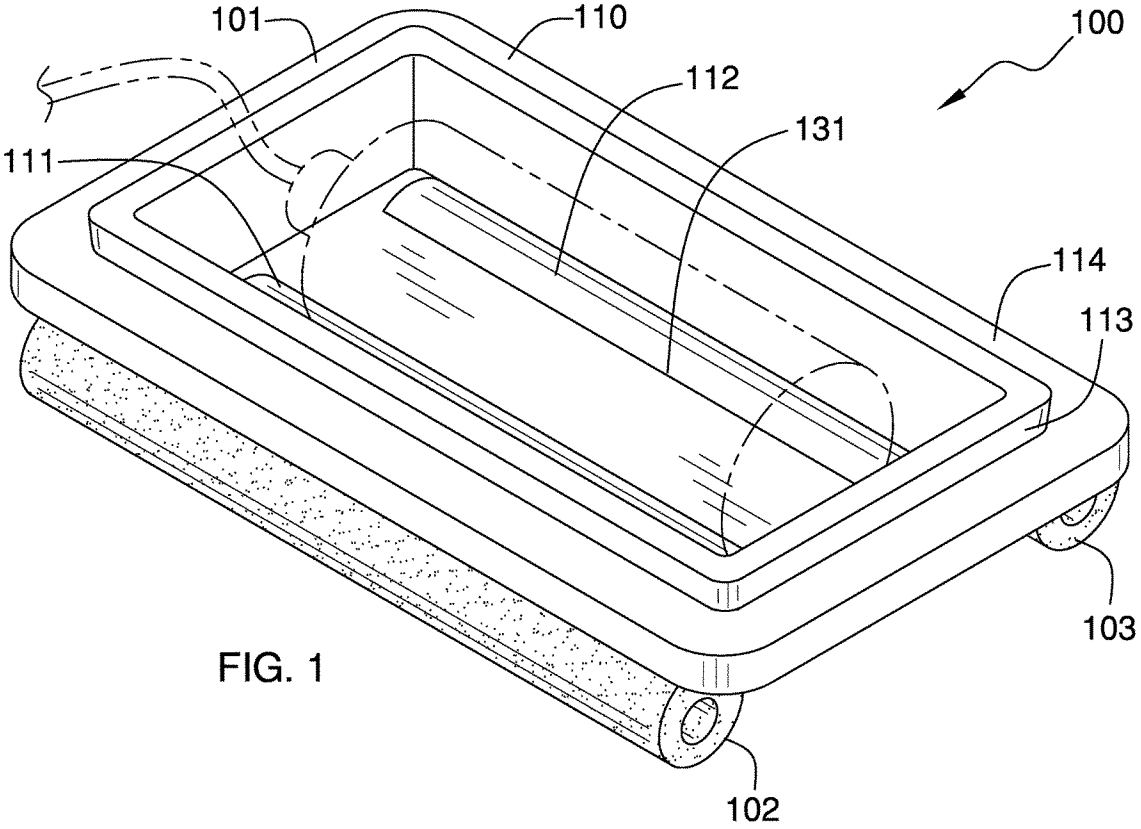
FIG. 1 is a top perspective view of an embodiment of the disclosure.
Figure 2:
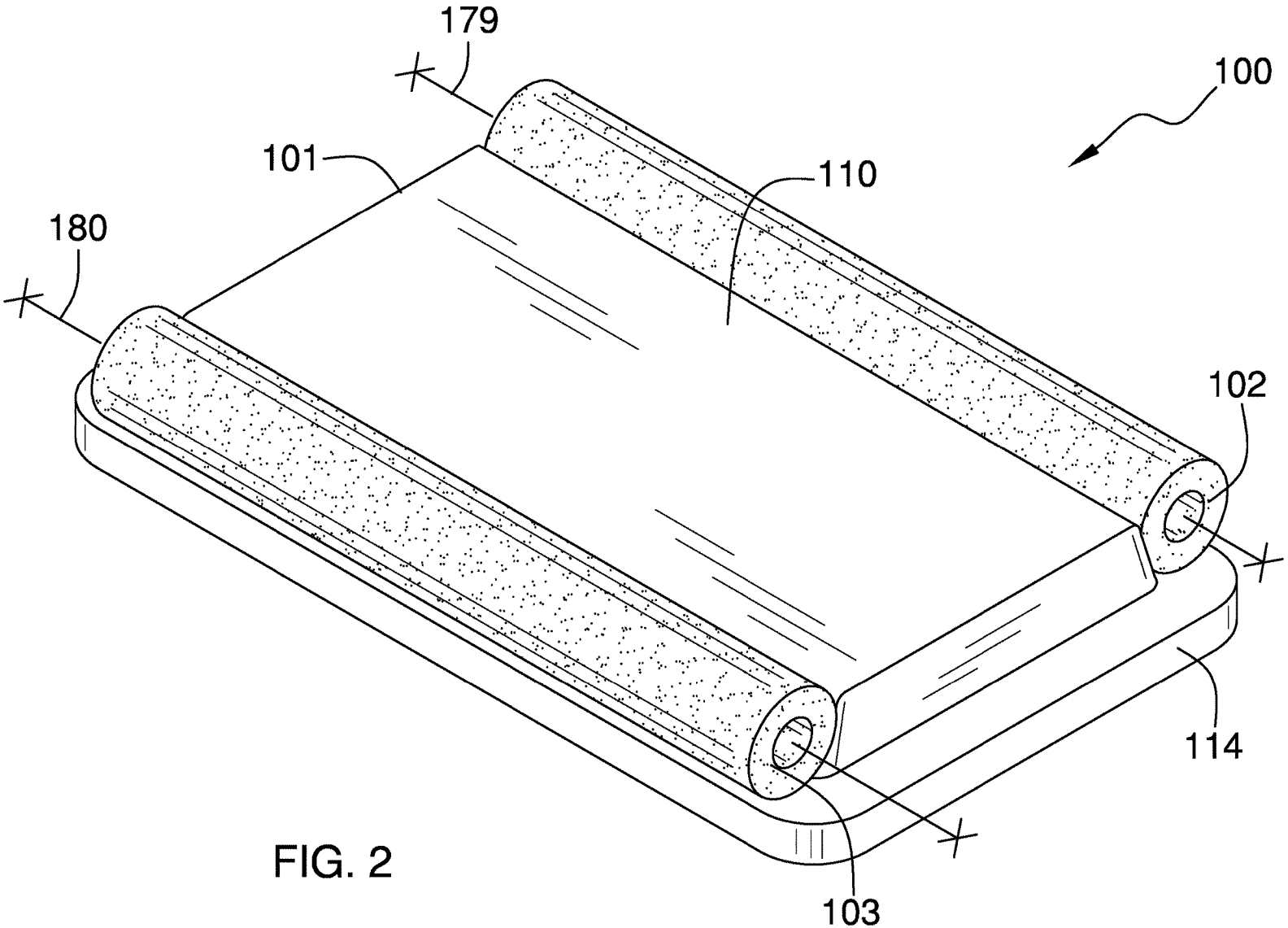
FIG. 2 is a bottom perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5.

The oxygen tank flotation device 100 (hereinafter invention) comprises a vessel 101, a first float 102, and a second float 103. The invention 100 is a floating structure adapted for use during recreational water activities. The invention 100 is adapted for use with respiratory equipment 131 that is required for use during recreational water activities. The invention 100 receives and stores respiratory equipment 131, such as an oxygen tank, in such a manner that the respiratory equipment 131 will float when the invention 100 is placed in a body of water 132. This arrangement allows the respiratory equipment 131 to float near the user when the user is involved in recreational water activities.

As shown most clearly in FIG. 1, the first float 102 is a cylindrical structure that is formed from a low density structural material. Suitable materials include, but are not limited to, polystyrene or polyurethane foam. The purpose of the first float 102 is to enhance the buoyancy of the invention 100 while the invention 100 is in use. The second float 103 is identical to the first float 102 in construction and use.

The vessel 101 is a receptacle within which the respiratory equipment 131 is placed and stored. The vessel 101 further comprises a container 110, a first bolster 111, a second bolster 112, a splash guard 113 and a gunnels 114. As shown most clearly in FIGS. 1, 2, and 5, the container 110 is a hollow structure that is formed in the shape of a truncated pyramid. The base of the truncated pyramid is open such that the hollow interior of the container 110 can be accessed. The first bolster 111 is a semi-cylindrical structure that is formed on the interior surface of the container 110 that is distal from the base of the truncated pyramid. The second bolster 112 is a semi-cylindrical structure that is formed on the interior surface of the container 110 that is distal from the base of the truncated pyramid.

Figure 3:
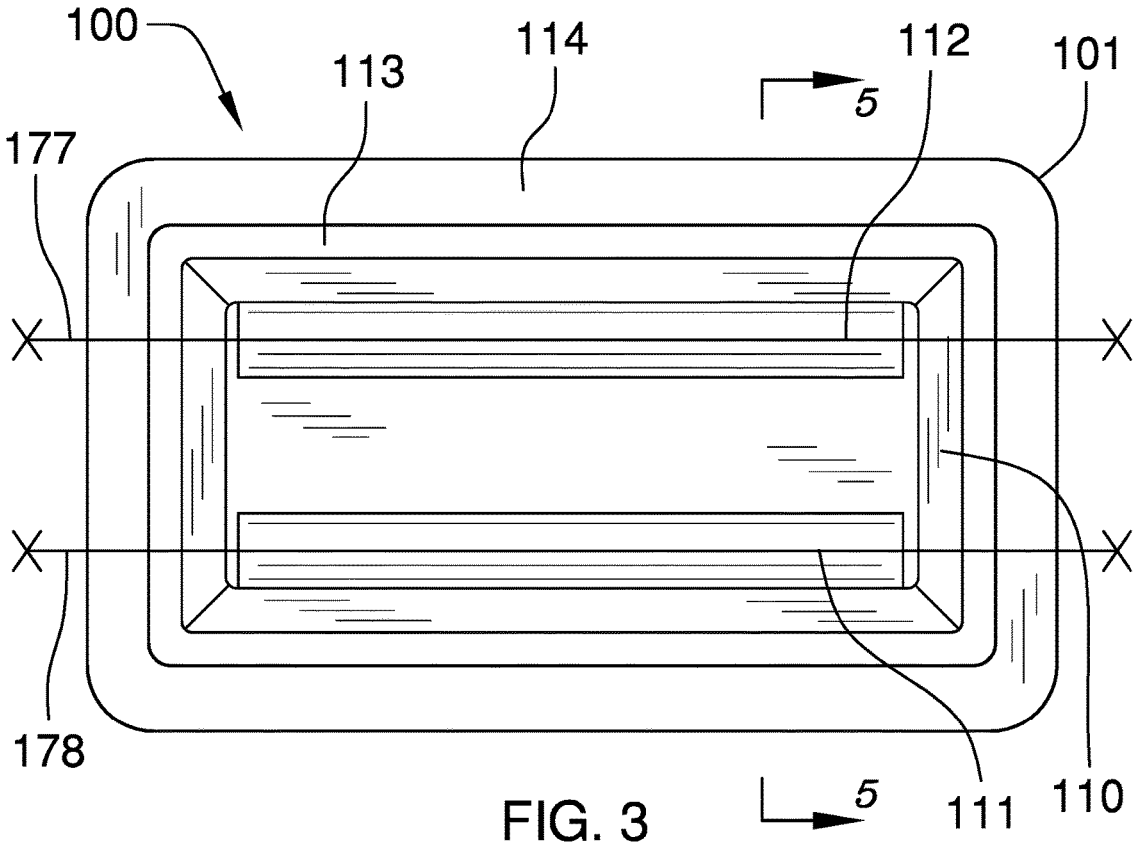
FIG. 3 is a top view of an embodiment of the disclosure.
Figure 4:
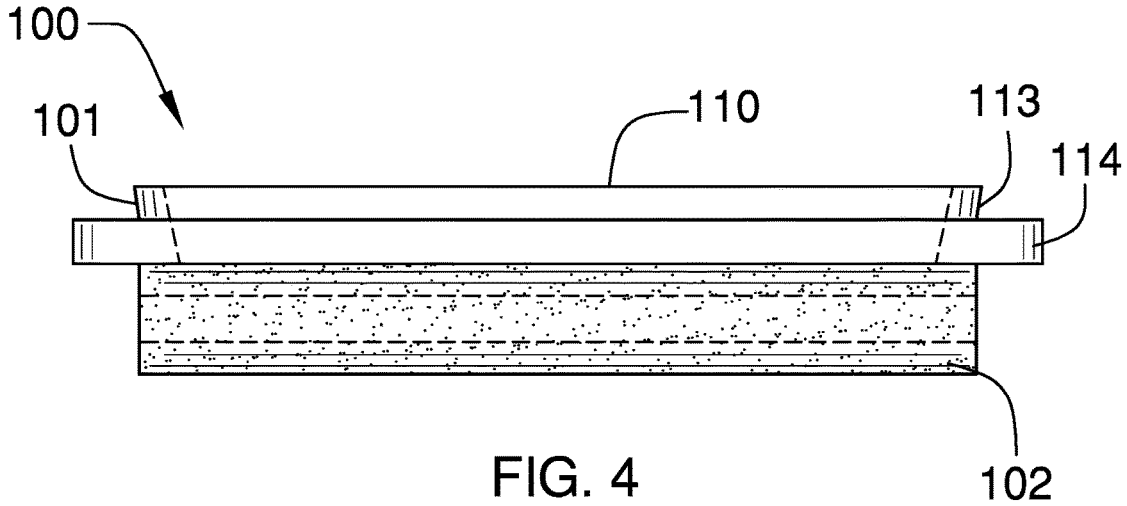
FIG. 4 is a side view of an embodiment of the disclosure.
Figure 5:
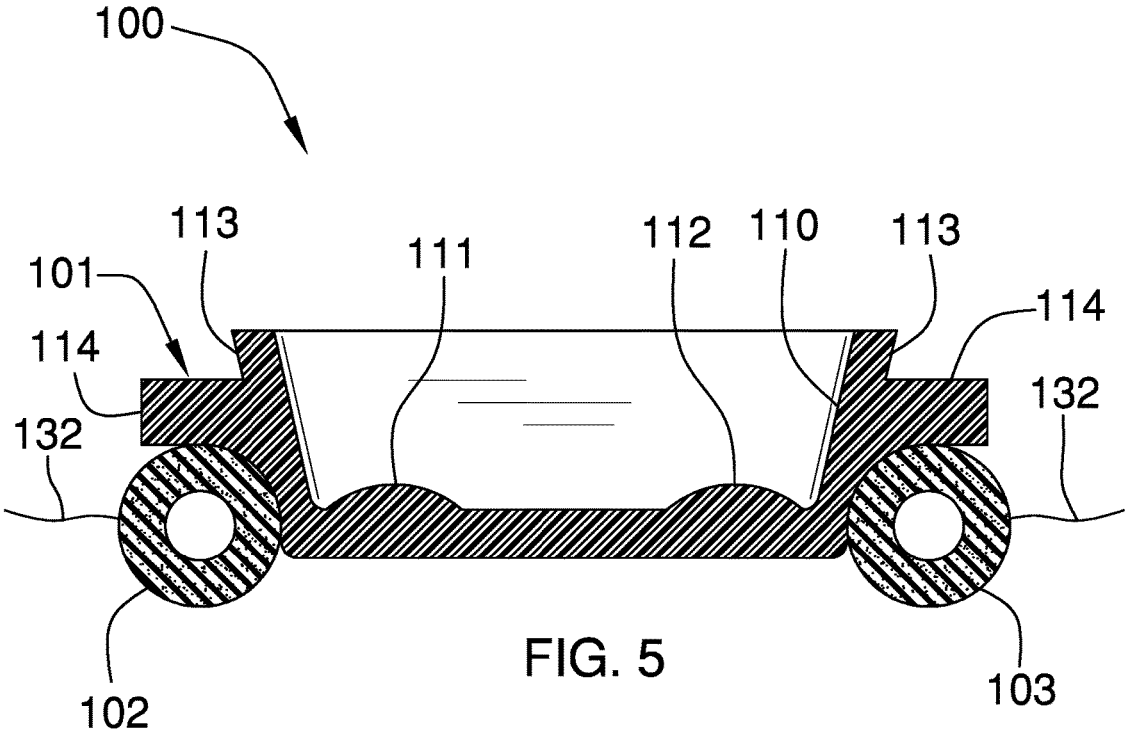
FIG. 5 is a cross-sectional view of an embodiment of the disclosure across 5-5 as shown in FIG. 3.

The second bolster 112 is positioned such that a second center axis 177 of the second bolster 112 is parallel to a first center axis 178 of the first bolster 111 (see FIG. 3). The purpose of the first bolster 111 and the second bolster 112 is to provide a barrier that prevents the respiratory equipment 131 from shifting while in the body of water 132. The first float 102 is generally parallel with the second float 103. Moreover, a third center axis 179 of the first float 102 is parallel to a fourth center axis 180 of the second float 103. The first axis 177, the second axis 178, the third axis 179, and the fourth axis 180 are all collectively parallel with one another.

As shown most clearly in FIG. 1, The gunnels 114 is a rectangular structure that forms a surface: 1) that projects away from the container 110 in a direction away from the interior space of the container 110; and, 2) that is parallel to the surface of the plane that truncates the truncated pyramidal structure that forms the container 110. The gunnels 114 is located such that the base face of the truncated pyramid that forms the container 110 forms a different plane than plane formed by the surface formed by the gunnels 114. The portion of the container 110 that is between the gunnels 114 and the base face of the truncated pyramid that forms the container 110 is referred to as the splash guard 113. The purpose of the splash guard 113 is to prevent water from entering the hollow interior of the container 110.

As shown most clearly in FIGS. 1, 2, 4, and 5, the final assembly of the invention 100 involves attaching the first float 102 and the second float 103 to the gunnels 114 such that the first float 102 and the second float 103 is located between the body of water 132 and the gunnels 114.

To use the invention 100, the respiratory equipment 131 is placed within the container 110 such that the respiratory equipment 131 is positioned between the first bolster 111 and the second bolster 112. The invention 100 is then placed into the body of water 132 such that the solid surface of container 110 separates the body of water 132 and the respiratory equipment 131.

In the first potential embodiment of the disclosure, the vessel 101 is molded as a single unit from a low density structural foam. Suitable low density structural foams include, but are not limited to, polystyrene or polyurethane foam. The first float 102 and the second float 103 are formed from readily and commercially available pool noodles and are attached to the vessel 101 with adhesive. In a second potential embodiment of the disclosure, the invention 100 is molded as a single unit from a low density structural foam. Suitable low density structural foams include, but are not limited to, polystyrene or polyurethane foam.

The following definitions were used in this disclosure:

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Frustum: As used in this disclosure, a frustum is a portion of a solid that lies between two parallel planes that intersect with the solid.

Pyramid: As used in this disclosure, a pyramid is a three dimensional shape that comprises a square base with four faces that rise from the base to meet at a point above the base. If the point where the four faces meet is positioned such that a line drawn from the point where the four faces meet to the center of the square base is perpendicular to the square base, the pyramid is referred to as a right pyramid. Pyramids formed from rectangular bases instead of square bases are referred to as rectangular pyramids.

Semi-Cylinder: As used in this disclosure, a semi-cylinder is half of a cylinder divided lengthwise.

Truncated Pyramid: As used in this disclosure, a truncated pyramid is a frustum that remains when the apex of a pyramid is truncated by a plane that is parallel to the base of the pyramid.

Truncated: As used in this disclosure, a geometricobject is truncated when an apex, vertex, or end is cut off by a plane.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A flotation device comprising:

a vessel, a first float, and a second float;

wherein the flotation device is a floating structure adapted for use during recreational water activities;

wherein the flotation device is adapted for use with respiratory equipment;

wherein the flotation device receives and stores respiratory equipment in such a manner that the respiratory equipment will float when placed in a body of water;

wherein the first float is a cylindrical structure;

wherein the second float is a cylindrical structure;

wherein the vessel further comprises a container, a first bolster, a second bolster, and gunnels;

wherein the first float is attached to the vessel;

wherein the second float is attached to the vessel;

wherein the container is a structure with a hollow interior that is formed in a shape of a truncated pyramid;

wherein a base of the truncated pyramid is open such that the hollow interior of the container is accessible;

wherein the first bolster is a semi-cylindrical structure that is formed on an interior surface of the container that is distal from the base of the truncated pyramid.

2. The flotation device according to claim 1 wherein the second bolster is a semi-cylindrical structure that is formed on the interior surface of the container that is distal from the base of the truncated pyramid.

3. The flotation device according to claim 2 wherein the second bolster is positioned such that a second center axis of the second bolster is parallel to a first center axis of the first bolster.

4. The flotation device according to claim 3 wherein the gunnels is a rectangular structure that forms a surface that projects away from the container in a direction away from the hollow interior of the container.

5. The flotation device according to claim 4 wherein the gunnels is parallel to a surface of a plane that truncates the truncated pyramidal structure that forms the container.

6. The flotation device according to claim 5 wherein the gunnels is located such that the base face of the truncated pyramid that forms the container forms a different plane than a plane formed by the surface formed by the gunnels.

7. The flotation device according to claim 6 wherein a splash guard is positioned between the gunnels and the base face of the truncated pyramid that forms the container.

8. The flotation device according to claim 7 wherein the first float is attached to the gunnels such that the first float is located between the body of water and the gunnels.

9. The flotation device according to claim 8 wherein the second float is attached to the gunnels such that the second float is located between the body of water and the gunnels.

10. The flotation device according to claim 1 wherein the first float is attached to the gunnels such that the first float is located between the body of water and the gunnels;

wherein the second float is attached to the gunnels such that the second float is located between the body of water and the gunnels.

11. The flotation device according to claim 10 wherein a splash guard is positioned between the gunnels and the base face of the truncated pyramid that forms the container.

12. The flotation device according to claim 11 wherein the gunnels is a rectangular structure that forms a surface that projects away from the container in a direction away from the hollow interior of the container;

wherein the gunnels is parallel to a surface of a plane that truncates the truncated pyramidal structure that forms the container;

wherein the gunnels is located such that the base face of the truncated pyramid that forms the container forms a different plane than plane formed by the surface formed by the gunnels.

13. The flotation device according to claim 12 wherein the container is a structure with a hollow interior that is formed in a shape of a truncated pyramid;

wherein the first bolster is a semi-cylindrical structure that is formed on a interior surface of the container that is distal from the a base of the truncated pyramid;

wherein the second bolster is a semi-cylindrical structure that is formed on the interior surface of the container that is distal from a base of the truncated pyramid.

14. The flotation device according to claim 13 wherein the second bolster is positioned such that the center axis of the second bolster is parallel to the center axis of the first bolster.

* * * * *